US005370549A

United States Patent [19]

Lee

[11] Patent Number: 5,370,549

[45] Date of Patent: Dec. 6, 1994

[54] SLIDABLY ENGAGING AND DISENGAGING PGA CONNECTOR INTEGRATED WITH SIMPLIFIED MANIPULATING MEMBER

[76] Inventor: Chih-Chung Lee, c/o Hung Hsing Patent Service Center P.O. Box 55-1670, Taipei (104), Taiwan, Prov. of China

[21] Appl. No.: 136,199

[22] Filed: Oct. 15, 1993

[51] Int. Cl.[5] ..... H01R 4/50

[52] U.S. Cl. ..... 439/342; 439/361

[58] Field of Search ..... 439/259–264, 439/266, 267, 268, 269, 342, 341

[56] References Cited

U.S. PATENT DOCUMENTS

| | | | |
|---|---|---|---|
| 4,498,725 | 2/1985 | Bright et al. | 439/342 |
| 4,648,669 | 3/1987 | Marks et al. | 439/261 |
| 4,988,310 | 1/1991 | Bright et al. | 439/342 |
| 5,057,031 | 10/1991 | Sinclair | 439/342 |
| 5,256,080 | 10/1993 | Bright | 439/342 |

*Primary Examiner*—David L. Pirlot
*Assistant Examiner*—Hien D. Vu

[57] ABSTRACT

A PGA connector includes: a shuttle plate slidably engageable on a socket base having a plurality of sockets recessed in the base, and a plurality of contact elements each contact element embedded in each socket in the socket base, the shuttle plate integrally formed with at least one resilient lever on a side plate portion longitudinally formed on a side portion of the shuttle plate and slidably resiliently urging a positioning lug formed on a side wall of the socket base, whereby upon forwardly sliding of the shuttle plate having an electronic package of pin grid arrays (PGA) mounted on the shuttle plate with the PGA leads pre-inserted into the sockets in the base by passing through a plurality of lead holes formed in the shuttle plate to keep an insertable buffer distance between each contact element and each lead, the positioning lug on the socket base will be engageably locked by a detention hook portion formed on a rear portion of the resilient lever for firmly engaging each PGA lead with each contact element fixed in the base to have an effective electrical connection between the PGA and an electronic circuit on a printed circuit board.

3 Claims, 2 Drawing Sheets

SLIDABLY ENGAGING AND DISENGAGING PGA CONNECTOR INTEGRATED WITH SIMPLIFIED MANIPULATING MEMBER

BACKGROUND OF THE INVENTION

Bright et al. disclosed a ZIF PGA socket and a tool for use therewith in their U.S. Pat. No. 4,988,310, requiring an additional tool 132 for moving the cover 44 and engaging the leads 120 of electronic package with contact element 94 of the socket. Much a tool 132 still occupies great space and requires complex mechanism, thereby increasing production cost, operating (opening and closing) inconvenience and maintenance problems. It may limit the use in some electronic circuits for central processing units (CPU) used in a compact computer device having small dimensions.

Therefore, the present inventor invents a PGA connector having simplified manipulating member integrally formed on the connector

SUMMARY OF THE INVENTION

The object of the present invention is to provide a PGA connector including: a shuttle plate slidably engageable on a socket base having a plurality of sockets recessed in the base, and a plurality of contact elements each contact element embedded in each socket in the socket base, the shuttle plate integrally formed with at least one resilient lever on a side plate portion longitudinally formed on a side portion of the shuttle plate and slidably resiliently urging a positioning lug formed on a side wall of the socket base, the shuttle plate having an electronic package of pin grid arrays (PGA) mounted on the shuttle plate with the PGA leads preinserted into the sockets in the base by passing through a plurality of lead holes formed in the shuttle plates, and an insertable buffer distance kept between each contact element and each lead, whereby upon forwardly sliding of the shuttle plate on the socket base, the positioning lug on the socket base will be engageably locked by a detention hook portion formed on a rear portion of the resilient lever of the shuttle plate for firmly engaging each PGA lead with each contact element fixed in the base to have an effective electrical connection between the PGA and an electronic circuit on a printed circuit board.

DETAILED DESCRIPTION

Figure 1:
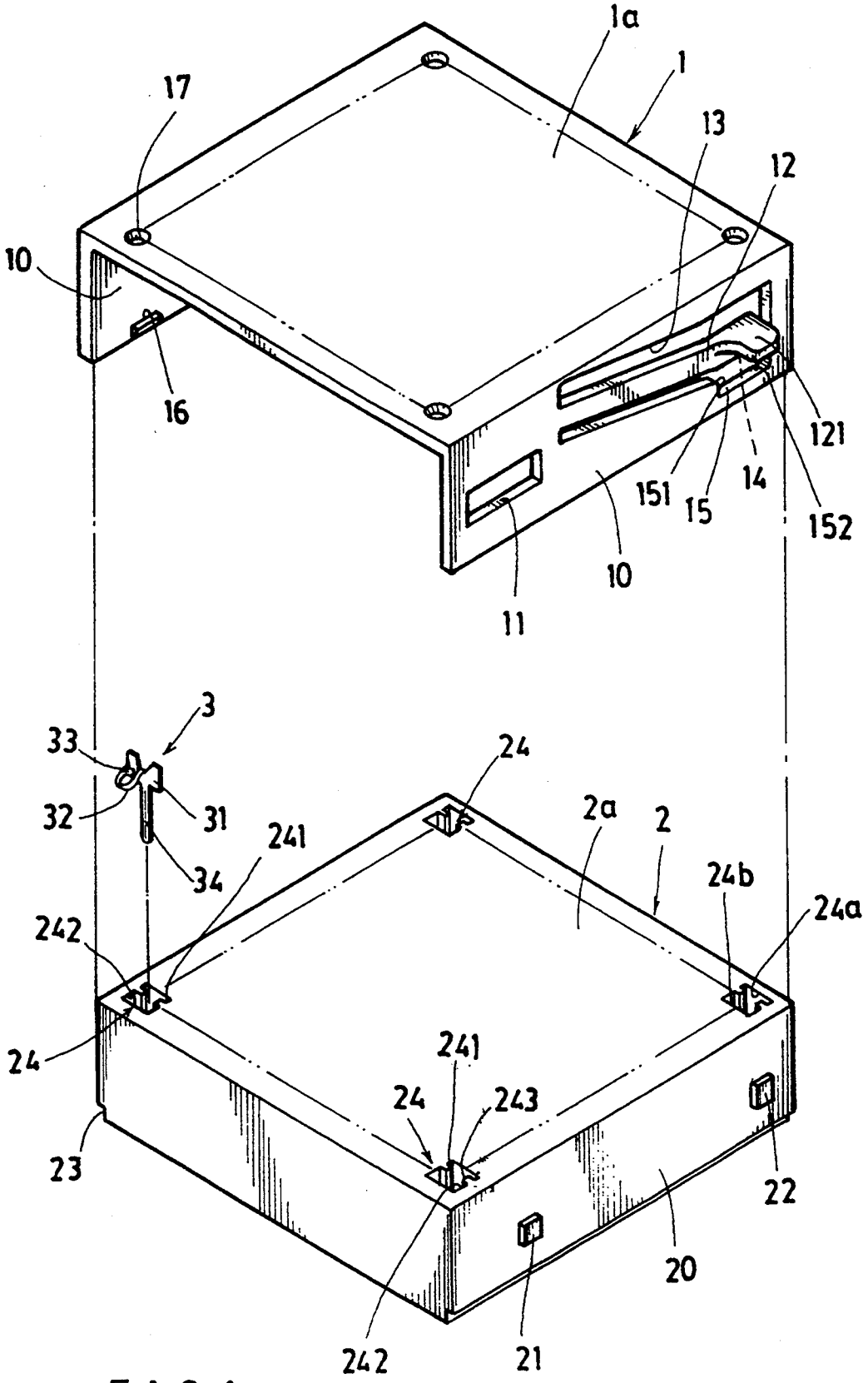
FIG. 1 is a perspective view of the present invention.
Figure 2:
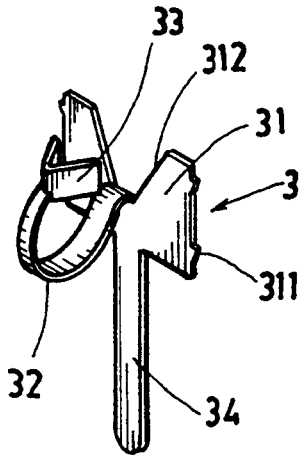
FIG. 2 is a perspective view of the contact element of the present invention.
Figure 3:
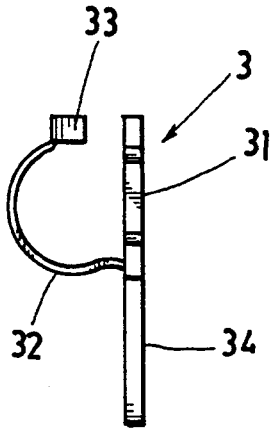
FIG. 3 is a side view of the contact element of the present invention.

As shown in FIGS. 1–7, the present invention comprises: a shuttle plate 1, a socket base 2, and a plurality of contact elements 3 for connecting leads 41 of an electronic package or a central processing unit (CPU) 4 such as pin grid arrays (PGA) with circuits on a printed circuit board.

The shuttle plate 1 includes: a pair of side plate portions 10 longitudinally formed on two opposite sides of a cover plate portion 1*a*, each side plate portion 10 having a front slot 1 notched in a front portion of the side plate portion 10, a resilient lever 12 integrally formed on each side plate portion 10 and protruding rearwardly with a slight slope inclined rearwardly downwardly from a central portion of the side plate portion 10 within a rear slot 13 longitudinally cut out in a central rear portion of the side plate portion 10, a handle portion 121 formed on a rear portion of the resilient lever 12 for biasing the resilient lever 12 for disengaging the shuttle plate 1 from the socket base 2, a detention hook portion 14 formed on a rear bottom portion of the resilient lever 12 engageable with a positioning lug 22 formed on the socket base 2, a lower slot 15 cut out in a rear lower portion of the side plate portion 10 for slidably holding the positioning lug 22 of the socket base 2 on the lower slot 15, a plurality of bottom lugs 16 longitudinally formed on a bottom portion of the side plate portion 10, and a plurality of lead holes 17 formed through the cover plate portion 1*a* of the shuttle plate 1 for passing each lead 41 of pin grid arrays (PGA) of an electronic package or CPU 4 through each lead hole 17.

Figure 4:
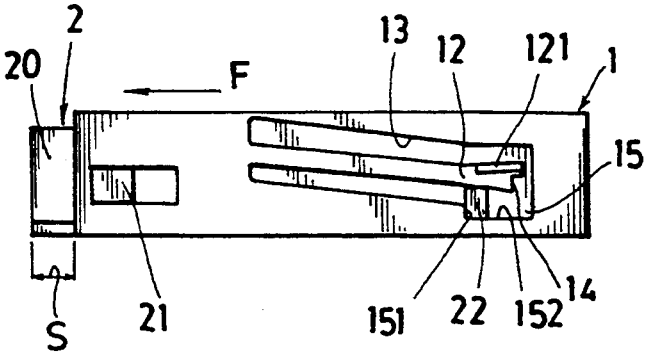
FIG. 4 is a side-view illustration of the present invention when a shuttle plate is disengaged from the socket base in accordance with the present invention.
Figure 6:
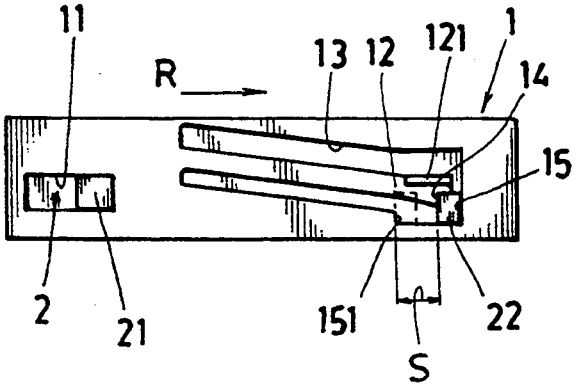
FIG. 6 shows a locking condition of the shuttle plate on the socket base of the present invention.
Figure 7:
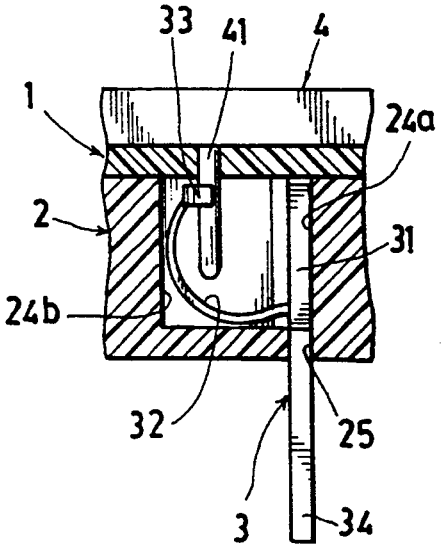
FIG. 7 is a sectional drawing showing a locking condition of the present invention derived from FIG. 6.

The socket base 2 includes: a plurality of sockets 24 recessed in an upper surface 2*a* of the base 2 for respectively inserting the leads 41 into the sockets 24, two side walls 20 longitudinally disposed on two opposite sides of the socket base 2, a plurality of leg holes 25 formed through the base 2 each leg hole 25 communicating with each socket 24 recessed in the base 2 for passing each connecting leg 34 of each contact element 3 embedded in each socket 24 in the base 2 for connecting an electronic circuit (not shown) of a printed circuit board secured to the base 2, a guiding lug 21 formed on a front portion of each side wall 20 slidably engageable with the front slot 11 in the shuttle plate 1, the positioning lug 22 formed on a rear portion of the side wall 20 slidably held in the lower slot 15 in the shuttle plate 1 as limited between a front stopping extension 151 and a rear stopping extension 152 of the lower slot 15, with the positioning lug 22 slidably resiliently contacted with a rear portion of the resilient lever 12 of the shuttle plate 1 and engageable with the detention hook portion 14 of the lever 12, whereby when thrusting the shuttle plate 1 forwardly (F) from the situation as shown in FIG. 4 to that of FIG. 6, the detention hook portion 14 of the lever 12 of the shuttle plate 1 will be locked on the positioning lug 22 of the base 2, and a pair of bottom grooves 23 longitudinally recessed in two opposite bottom sides of the base 2 to be slidably engageable with the bottom lugs 16 formed on two side plate portions 10 of the shuttle plate I.

Each contact element 3 of the present invention embedded in each socket 24 in the socket base 2 includes: a holding plate portion 31 having a plurality of side teeth (such as ratchet teeth) 311 vertically formed on two opposite side edge portions of the holding plate portion to be firmly fixed in a rear cavity 241 of each socket 24 in the socket base 2, an arcuate arm member 32 punched and bent forwardly from a central notch 312 in the holding plate portion 31 of the contact element 3 to protrude forwardly through a central opening of a partition 243, which is defined between the rear cavity 241 adjacent to a rear socket wall 24*a* and a front cavity 242 adjacent to a front socket wall 24*b* of each said socket 24, to be extended into the front cavity 242, a V-shaped clamping member 33 secured to an upper portion of the arm member 32 for contacting the lead 41 of the electronic package 4, and the connecting leg 34 protruding downwardly from the holding plate portion 31 of the contact element 3 to pass through each leg hole 25 formed in the base 2.

Figure 5:
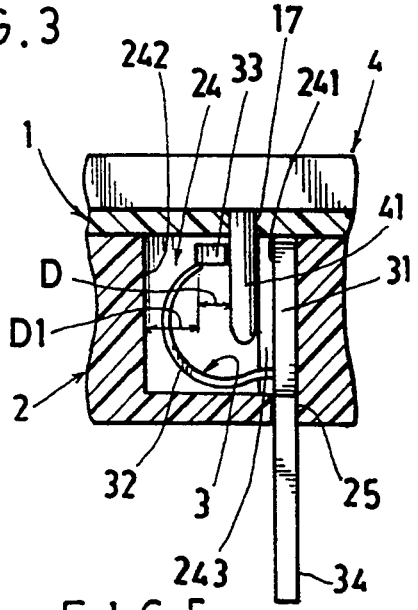
FIG. 5 is a sectional drawing showing a zero-insertion-force plugging of a PGA lead in a socket of the present invention as derived from FIG. 4.

The V-shaped clamping member 33 of the contact element 3 normally defines an insertable buffer distance D between the V-shaped clamping member 33 and the lead 41 of the electronic package (PGA) 4 as shown in FIG. 5, with the buffer distance D being larger than a diameter of each said lead 41 for an easy insertion of the lead 41 into the socket 24 in the base 2 such as with zero insertion force (ZIF), said V-shaped clamping member 33 normally spaced from the front socket wall 24*b* by a clamping buffer distance D1, whereby upon forwardly sliding of the shuttle plate 1 on the socket base 2 with a stroke S as shown in FIG. 6 (from FIG. 5) to engage the positioning lug 22 of the socket base 2 with the rear stopping extension 152 of the lower slot 15 of the shuttle plate 1, the shuttle plate 1 will be locked on the socket base 2 by stably engaging the detention hook portion 14 of the resilient lever 12 with the positioning lug 22.

Therefore, the stroke S by sliding the shuttle plate 1 on the socket base 2 should be larger than the insertable buffer distance D ($S>D$) to ensure a resiliently clamping of the lead 41 by the clamping member 33 of the contact element 3, while the stroke S should be smaller than a total distance of the insertable buffer distance D plus the clamping buffer distance D1, i.e., $(D+D1)>S$, to prevent an over stress occurring during the resilient clamping of the lead 41 by the clamping member 33 of the contact element 3.

When biasing the lever 12 to disengage the hook portion 14 from the positioning lug 22, the shuttle plate 1 can be retracted (R) from the base 2 to open the connector for maintenance.

The present invention is superior to the prior art, such as U.S. Pat. No. 4,988,310 with the following advantages:

1. The resilient lever 12 is integrally formed (formed in situ) on the shuttle plate 1, without further assembly, thereby saving production cost, simplifying the operation, decreasing the maintenance problem.

2. The complex or greatly outwardly extending parts provided on the connector structure have been eliminated, thereby minimizing the total volume of the connector especially suitable for uses in a compact computer device.

I claim:

1. A PGA connector comprising: a socket base (2) having a plurality of sockets (24) recesed therein, and at least one positioning lug (22) formed on a side wall (20) of said base (2);

a plurality of contact elements (3) each said contact element (3) embedded in each said socket (24) in said base (2); and a shuttle plate (1) slidably held on said socket base (2) and having a plurality of lead holes (17) each said lead hole (17) formed through said shuttle plate for passing each lead (41) of an electronic package of pin grid arrays (PGA) through each said lead hole (17) to be inserted into each said socket (24) in said base (2) to be connected with an electronic circuit of a printed circuit board secured to said base (2), and having a resilient lever (12) integrally formed on a side plate portion (10) of said shuttle plate (1), whereby upon sliding movement of said shuttle plate (1) on said socket base (2) to engage said resilient lever (12) with said positioning lug (22) of said socket base (2), each said lead (41) will be resiliently clamped by each said contact element (3) for an effective connection between said lead (41) and said contact element (3);

said shuttle plate (1) including: a pair of said side plate portions (10) longitudinally formed on two opposite sides of a cover plate portion (1*a*), each said side plate portion (10) having a front slot (11) notched in a front portion of the side plate portion (10), the resilient lever (12) integrally formed on each said side plate portion (10) and protruding rearwardly with a slight slope inclined rearwardly downwardly from a central portion of the side plate portion (10) within a rear slot (13) longitudinally cut out in a central rear portion of the side plate portion 10, a handle portion (121) formed on a rear portion of the resilient lever (12) for biasing the resilient lever (12) for disengaging the shuttle plate (1) from the socket base (2), a detection hook portion (14) formed on a rear bottom portion of the resilient lever (12) and engageable with a positioning lug (22) formed on the socket base (2), a lower slot (15) cut out in a rear lower portion of the side plate portion (10) for slidably holding the positioning lug (22) of the socket base (2) on the lower slot (15), and a plurality of bottom lugs (16) longitudinally formed on a bottom portion of the side plate portion (10); and said socket base (2) including: a plurality of said sockets (24) each said socket (24) recessed in an upper surface (2*a*) of the base (2) for inserting each said lead (41) into each said socket (24), two side walls (20) longitudinally disposed on two opposite sides of the socket base (2), a plurality of leg holes (25) formed through the base (2) each said leg hole (25) communicating with each said socket (24) recessed in the base (2) for passing a connecting leg (34) of each said contact element (3) embedded in each said socket (24) in the base (2) for connecting an electronic circuit of a printed circuit board secured to said base (2), a guiding lug (21) formed on a front portion of each said side wall (20) slidably engageable with the front slot (11) in the shuttle plate (1), the positioning lug (22) formed on a rear portion of the side wall (20) slidably held in the lower slot (15) in the shuttle plate (1) as limited between a front stopping extension (151) and a rear stopping extension (152) of the lower slot (15), with the positioning lug (22) slidably resiliently contacted with a rear portion of the resilient lever (12) of the shuttle plate (1) and engageable with the detection hook portion (14) of the lever (12), whereby when thrusting the shuttle plate (1) forwardly, the detention hook portion (14) of the lever (12) of the shuttle plate (1) will be locked on the positioning lug (22) of the base (2), and a pair of bottom grooves (23) longitudinally recessed in two opposite bottom sides of the base (2) to be slidably engageable with the bottom lug (16) formed on two side plate portions (10) of the shuttle plate (1).

2. A PGA connector according to claim 1, wherein each said contact element (3) embedded in each said socket (24) in the socket base (2) includes: a holding plate portion (31) having a plurality of side teeth (311) formed on two opposite side edge portions of the holding plate portion (31) to be firmly fixed in a rear cavity (241) of each said socket (24) in the socket base (2), an arcuate arm member (32) punched and bent forwardly from a central notch (312) in the holding plate portion (31) of the contact element (3) to protrude forwardly through a central opening of a partition (243), which is defined between the rear cavity (241) adjacent to a rear socket wall (24*a*) and a front cavity (242) adjacent to a front socket wall (24*b*) of each said socket (24), to be extended into the front cavity (242), a V-shaped clamping member (33) secured to an upper portion of the arm member (32) for contacting the lead (41) of the electronic package (4), and the connecting leg (34) protruding downwardly from the holding plate portion (31) of the contact element (3) to pass through each said leg hole (25) formed in the base (2).

3. A PGA connector according to claim 2, wherein said V-shaped clamping member (33) of the contact element (3) normally defines an insertable buffer distance D between the V-shaped clamping member (33) and the lead (41) of the electronic package (4), with the buffer distance D being larger than a diameter of each said lead (41) for an easy insertion of the lead (41) into the socket (24) in the base (2), said V-shaped clamping member (33) normally spaced from the front socket wall (24*b*) by a clamping buffer distance D1, whereby upon forwardly sliding of the shuttle plate (1) on the socket base (2) with a stroke S to engage the positioning lug (22) of the socket base (2) with the rear stopping extension (152) of the lower slot (15) of the shuttle plate (1), the shuttle plate (1) will be locked on the socket base (2) by stably engaging the detection hook portion (14) of the resilient lever (12) with the positioning lug (22); said stroke S by sliding the shuttle plate (1) on the socket base (2) being larger than the insertable buffer distance D ($S>D$) to ensure a resiliently clamping of the lead (41) by the clamping member (33) of the contact element (3), and said stroke S being smaller than a total distance of the insertable buffer distance D plus the clamping buffer distance D1, whereby $(D+D1)>S$, to prevent an over stress occurring during the resilient clamping of the lead (41) by the clamping member (33) of the contact element (3).

* * * * *